US006407719B1

(12) United States Patent
Ohira et al.

(10) Patent No.: US 6,407,719 B1
(45) Date of Patent: Jun. 18, 2002

(54) ARRAY ANTENNA

(75) Inventors: Takashi Ohira, Yokohama; Koichi Gyoda, Kyoto, both of (JP)

(73) Assignee: ATR Adaptive Communications Research Laboratories, Kyoto (JP)

( * ) Notice: Subject to any disclaimer, the term of this patent is extended or adjusted under 35 U.S.C. 154(b) by 0 days.

(21) Appl. No.: 09/786,726

(22) PCT Filed: Jul. 6, 2000

(86) PCT No.: PCT/JP00/04489

§ 371 (c)(1),
(2), (4) Date: Mar. 8, 2001

(87) PCT Pub. No.: WO01/05024

PCT Pub. Date: Jan. 18, 2001

(30) Foreign Application Priority Data

Jul. 8, 1999 (JP) ..... 11-194487

(51) Int. Cl.[7] ..... H01Q 21/00
(52) U.S. Cl. ..... 343/893; 343/817; 343/750
(58) Field of Search ..... 343/815, 817, 343/745, 749, 750, 833, 834, 836, 837

(56) References Cited

U.S. PATENT DOCUMENTS 3,560,978 A 2/1971 Himmel et al. ..... 343/833
3,742,513 A * 6/1973 Ehrenspeck ..... 343/817
4,700,197 A 10/1987 Milne ..... 343/837
5,235,343 A * 8/1993 Audren et al. ..... 343/816
5,767,807 A 6/1998 Pritchett ..... 343/833
6,288,682 B1 * 9/2001 Thiel et al. ..... 343/702

FOREIGN PATENT DOCUMENTS

| | | |
|---|---|---|
| JP | 4932239 | 8/1974 |
| JP | 5991707 | 5/1984 |
| JP | 6125304 | 2/1986 |
| JP | 5206717 | 8/1993 |
| JP | 10154911 | 6/1998 |

* cited by examiner

*Primary Examiner*—Tan Ho

(57) ABSTRACT

An array antenna apparatus includes a radiating element (6) for transmitting and receiving radio signals, and at least one parasitic element (7) arranged at a predetermined distance (d) away from the radiating element (6) and incapable of transmitting or receiving radio signals. The parasitic element (7) is connected with a variable-reactance element (23). A controller (100) changes the directivity of the array antenna by changing the reactance $X_n$ of the variable-reactance element (23). The variable-reactance element (23) is a varactor diode (D, D1), for example, and the controller (100) changes the backward bias voltage Vb applied to the variable-reactance diode (D, D1) to change the capacitance of the varactor diode (D, D1), thus changing the directivity of the array antenna. The array antenna has a low-cost and simplified structure compared with the prior art, while facilitating directivity control.

2 Claims, 8 Drawing Sheets

FIRST PREFERRED EMBODIMENT

FEEDING ANTENNA ELEMENT A0

PARASITIC VARIABLE REACTANCE ELEMENT A1—A6

FIRST PREFERRED EMBODIMENT

SECOND PREFERRED EMBODIMENT

ARRAY ANTENNA

TECHNICAL FIELD

The present invention relates to an array antenna apparatus which comprises a plurality of antenna elements and is capable of changing the directivity thereof.

BACKGROUND ART

FIG. 12 is a block diagram showing a configuration of a phased array antenna apparatus of the prior art. Referring to FIG. 12, for example, radio signals received by a plurality of n antenna elements 1-1 to 1-N aligned in a linear array 100 are inputted to a combiner 4 through low-noise amplifiers (LNAs) 2-1 to 2-N and variable phase shifters 3-1 to 3-N, respectively. The combiner 4 combines the N phase-shifted radio signals inputted to the combiner 4, and outputs a combined radio signal after combining the same to a radio receiver 5. The radio receiver 5 subjects the combined radio signal to processing such as frequency conversion into lower frequencies (down conversion) and data demodulation, and then, extracts and outputs a data signal.

The phased array antenna apparatus is an advanced antenna for obtaining a desired radiation pattern by exciting a plurality of radiating elements in a predetermined relative relationship among the phases thereof. As shown in FIG. 12, a plurality of variable phase shifters 3-1 to 3-N is used as means for setting a desired relative relationship among the exciting phases thereof.

As shown in FIG. 12, in the phased array antenna apparatus of the prior art, for example, a receiver side has to comprise a plurality of low-noise amplifiers 2-1 to 2-N, a plurality of variable phase shifters 3-1 to 3-N and the combiner 4, and thus, the apparatus is complicated in configuration, and therefore, the cost of manufacturing the apparatus becomes greatly higher. Then this drawback becomes more serious, in particular, when the number of antenna elements 1-1 to 1-N becomes larger.

It is an essential object of the present invention to provide an array antenna apparatus, having a simple configuration as compared to that of the prior art, and capable of remarkably reducing the manufacturing cost thereof, and also facilitating controlling the directivity thereof.

DISCLOSURE OF THE INVENTION

According to one aspect of the present invention, there is provided an array antenna apparatus comprising:

- a radiating element for transmitting and receiving a radio signal therethrough;
- at least one parasitic element incapable of transmitting and receiving any radio signal, said parasitic element arranged at a predetermined distance from the radiating element;
- a variable-reactance element connected to the parasitic element; and
- controlling means for changing directivity of the array antenna apparatus by changing a reactance of the variable-reactance element.

Also, in the above-mentioned array antenna, the variable-reactance element is preferably a varactor diode, and the controlling means changes capacitance of the varactor diode by changing a backward bias voltage applied to the varactor diode, thereby changing the directivity of the array antenna apparatus.

Further, the above-mentioned array antenna preferably further comprises:

- a plurality of the parasitic elements, arranged on a circumference of a predetermined circle around the radiating element.

Therefore, according to the present invention, the array antenna apparatus according to the present invention has a very simple structure as compared to that of the array antenna apparatus of the prior art shown in FIG. 12, and, for example, the use of the variable-reactance element such as a varactor diode makes it possible to realize the array antenna apparatus capable of electronically controlling the directivity at a direct-current voltage. The array antenna apparatus is easily mounted to electronic equipment such as a notebook type personal computer or a PDA so as to serve as an antenna for a mobile communication terminal, for example. Moreover, even when the main beam is scanned in any direction on a horizontal plane, all parasitic variable-reactance elements effectively function as wave directors or reflectors and also greatly facilitate the control of the directivity.

BEST MODE FOR CARRYING OUT THE INVENTION

Preferred embodiments of the present invention will be described below with reference to the accompanying drawings.

FIRST PREFERRED EMBODIMENT

Figure 1:
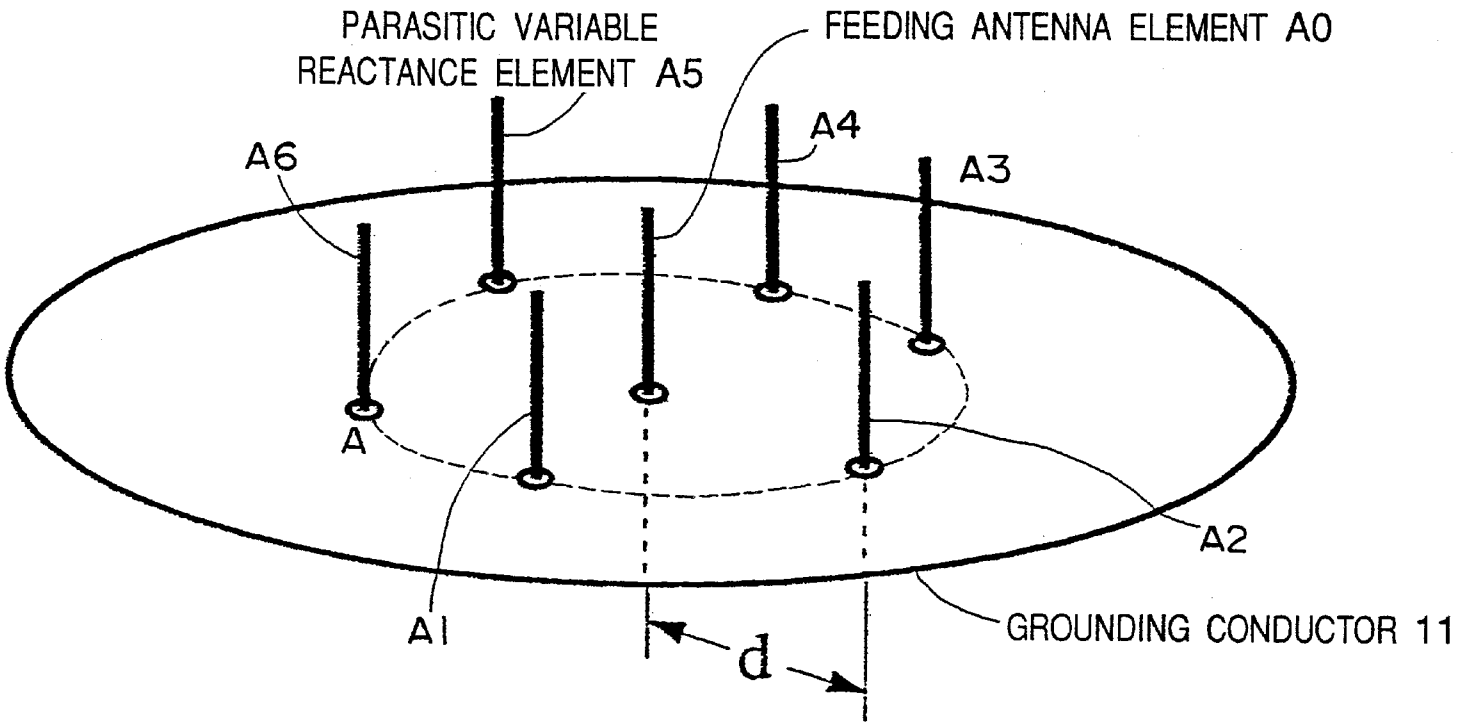
FIG. 1 is a perspective view showing a configuration of an array antenna apparatus according to a first preferred embodiment of the present invention.
Figure 2:
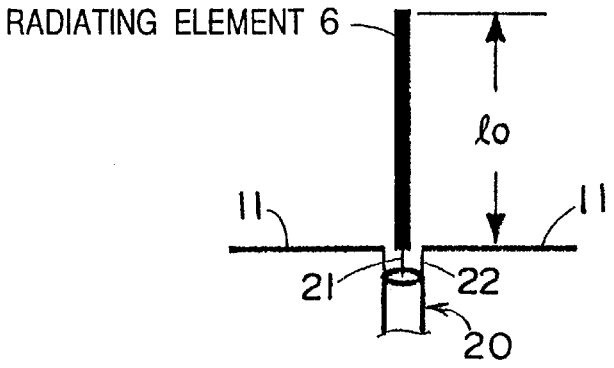
FIG. 2 is a schematic diagram showing a configuration of a feeding antenna element A0 shown in FIG. 1.
Figure 3:
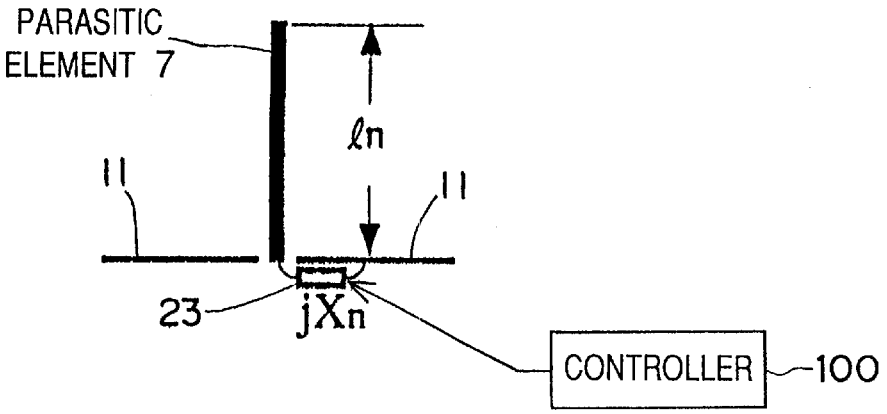
FIG. 3 is a schematic diagram showing a configuration of each of parasitic variable-reactance elements A1 to A6 shown in FIG. 1.

FIG. 1 is a perspective view showing a configuration of an array antenna apparatus according to a first preferred embodiment of the present invention, FIG. 2 is a schematic diagram showing a configuration of a feeding antenna element A0 shown in FIG. 1, and FIG. 3 is a schematic diagram showing a configuration of each of parasitic variable-reactance elements A1 to A6 shown in FIG. 1.

In the preferred embodiment, as shown in FIG. 1, the feeding antenna element A0 and the six parasitic variable-reactance elements A1 to A6, each of which is a monopole element, are electrically insulated from a grounding conductor 11 made of a conductor plate having an area large enough for lengths $l_{o\ ln}$ (n=1, 2, . . . , 6) of the elements A0 to A6. The parasitic variable-reactance elements A1 to A6 are spaced at a predetermined equal distance at an angle of 60degrees on the circumference of a circle having a radius d of, for example, λ/4 around the feeding antenna element A0.

Referring to FIG. 2, the feeding antenna element A0 comprises a cylindrical radiating element 6 having a predetermined longitudinal length $l_o$ of, for example, λ/4 and electrically insulated from the grounding conductor 11. A central conductor 21 of a coaxial cable 20 for transmitting a radio signal fed from a radio apparatus (not shown) is connected to one end of the radiating element 6, and an outer conductor 22 of the coaxial cable 20 is connected to the grounding conductor 11. Thus, the radio apparatus feeds a radio signal to the feeding antenna element A0 through the coaxial cable 20, and then, the radio signal is radiated by the feeding antenna element A0.

Referring to FIG. 3, each of the parasitic variable-reactance elements A1 to A6 has a similar structure comprising a cylindrical parasitic element 7 having a predetermined longitudinal length $l_n$ (n=1, 2, . . . , 6) of, for example, λ/4 and electrically insulated from the grounding conductor 11, and a variable-reactance element 23 having a reactance $X_n$ (n=1, 2, . . . , 6). The reactance $X_n$ of the variable-reactance element 23 is controlled by a controller 100 that is a digital computer, for example.

One end of the parasitic element 7 is grounded in high frequency bands to the grounding conductor 11 through the variable-reactance element 23. For example, under such an assumption that the longitudinal length of the radiating element 6 is substantially equal to that of the parasitic element 7, for instance when the variable-reactance element 23 is inductive (L characteristic), the variable-reactance element 23 changes into an extension coil, thus the electric lengths of the parasitic variable-reactance elements A1 to A6 are longer than the electric length of the feeding antenna element A0, and therefore, the parasitic variable-reactance elements A1 to A6 operate as reflectors. On the other hand, for instance when the variable-reactance element 23 is capacitive (C characteristic), the variable-reactance element 23 changes into a loading capacitor, thus the electric lengths of the parasitic variable-reactance elements A1 to A6 are shorter than the electric length of the feeding antenna element A0, and therefore, the parasitic variable-reactance elements A1 to A6 operate as wave directors.

Accordingly, the array antenna apparatus shown in FIG. 1 causes the controller 100 to change the reactance of the variable-reactance element 23 connected to the parasitic variable-reactance elements A1 to A6, and thus can change a directivity on horizontal plane of the whole array antenna apparatus.

Figure 4:
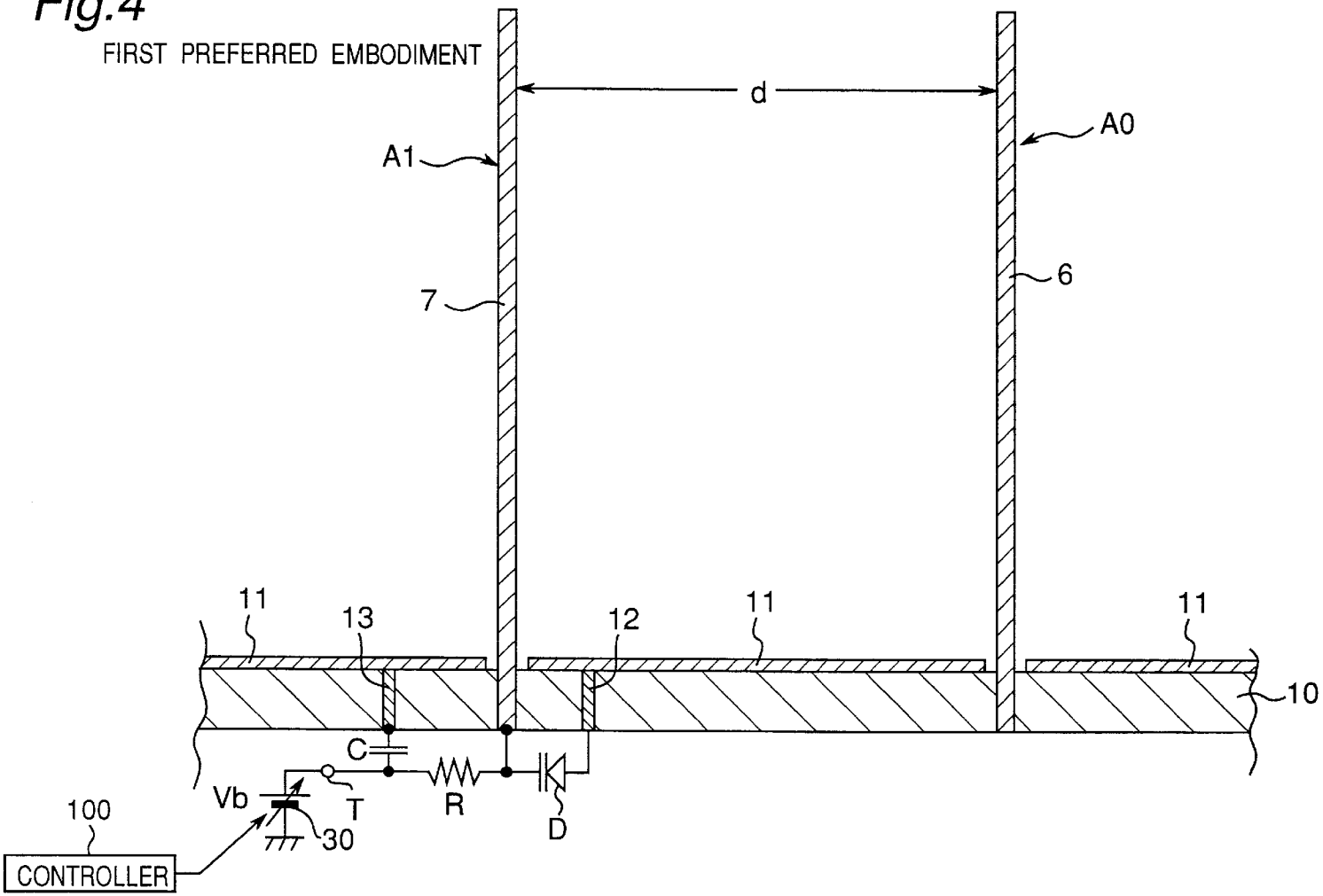
FIG. 4 is a cross sectional view showing a detailed configuration of the array antenna apparatus shown in FIG. 1.

FIG. 4 is a cross sectional view showing a detailed configuration of the array antenna apparatus shown in FIG. 1. In the preferred embodiment shown in FIG. 4, a varactor diode D is used as the variable-reactance element 23.

Referring to FIG. 4, the grounding conductor 11 is formed on a top surface of a dielectric substrate 10 made of polycarbonate or the like, for example. The radiating element 6 passes through and is supported by the dielectric substrate 10 in a direction of a thickness of the dielectric substrate 10 while being electrically insulated from the grounding conductor 11, and a radio signal is fed from a radio apparatus (not shown) to the radiating: element 6. While being electrically insulated from the grounding conductor 11, the parasitic element 7 passes through and is supported by the dielectric substrate 10 in the direction of the thickness of the dielectric substrate 10. One end of the parasitic element 7 is grounded in high frequency bands to the grounding conductor 11 through the varactor diode D and a through hole conductor 12 that passes through and is filled into the dielectric substrate 10 in the direction of the thickness of the dielectric substrate 10, and the one end of the parasitic element 7 is also connected to a terminal T through a resistor R. The terminal T is grounded in high frequency bands to the grounding conductor 11 through a high-frequency bypass capacitor C and a through hole conductor 13 that passes through and is filled into the dielectric substrate 10 in the direction of the thickness of the dielectric substrate 10.

A variable voltage direct-current power supply 30, whose voltage is controlled by the controller 100 of the array antenna apparatus, is connected to the terminal T. The controller 100 changes a backward bias voltage Vb applied to the varactor diode D by the variable voltage direct-current power supply 30, and this leads to change of capacitance of the varactor diode D. Thus, the electric length of the parasitic variable-reactance element A1 comprising the parasitic element 7 is changed as compared to the electric length of the feeding antenna element A0, and therefore, the a directivity on horizontal plane of the array antenna apparatus can be changed. Furthermore, the parasitic variable-reactance elements A2 to A6, each of which comprises the other parasitic element 7, are similarly constituted and thus have the similar function. The array antenna apparatus configured as described above can be called an electronically steerable passive array radiator antenna (ESPAR antenna).

Figure 12:
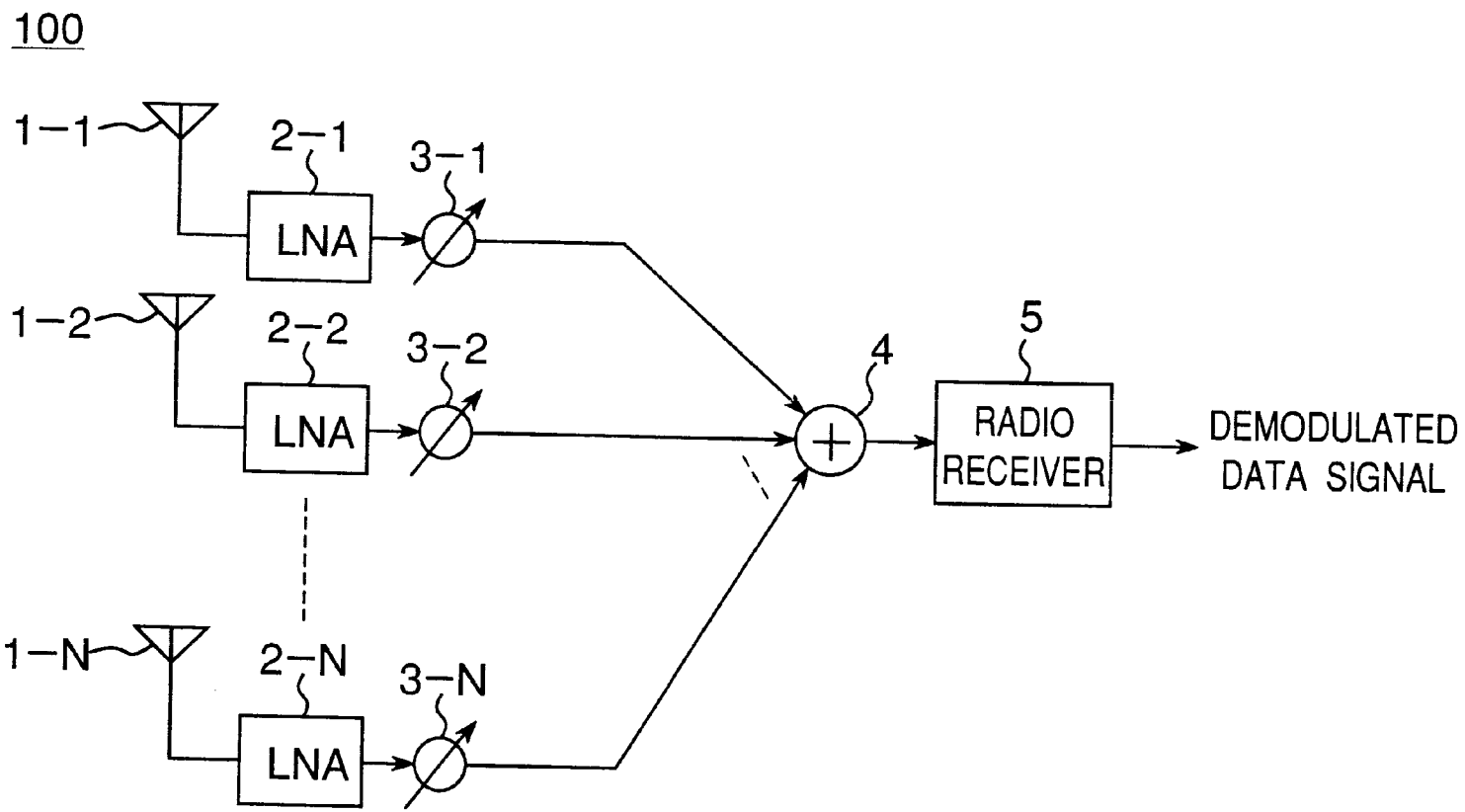
Fig.12 PRIOR ART
FIG. 12 is a block diagram showing a configuration of an array antenna apparatus of the prior art.

As described above, the first preferred embodiment of the present invention shown in FIGS. 1 to 4 has a very simple structure as compared to that of the array antenna apparatus of the prior art shown in FIG. 12. For example, the use of the varactor diode D makes it possible to realize the array antenna apparatus capable of electronically controlling the directivity thereof using direct-current voltages. The array antenna apparatus can be easily mounted to electronic equipment such as a notebook type personal computer or a PDA so as to serve as an antenna for a mobile communication terminal, for instance. Moreover, even when the main beam thereof is scanned in any direction on a horizontal plane, all the parasitic variable-reactance elements A1 to A6 effectively function as wave directors or reflectors and also greatly facilitate the control of the directivity.

SECOND PREFERRED EMBODIMENT

Figure 5:
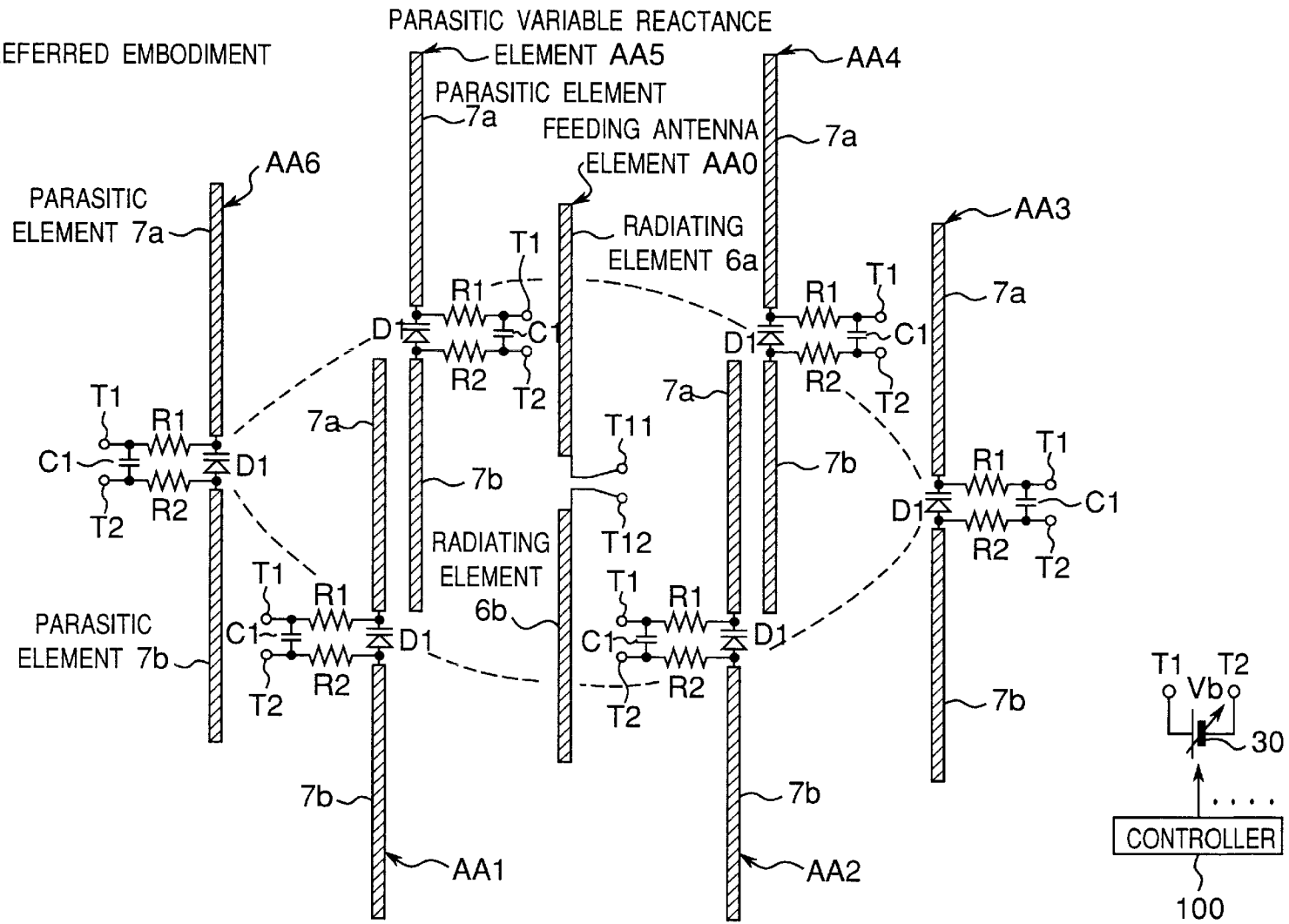
FIG. 5 is a perspective view showing a configuration of an array antenna apparatus according to a second preferred embodiment of the present invention.

FIG. 5 is a perspective view showing a configuration of an array antenna apparatus according to a second preferred embodiment of the present invention. The array antenna apparatus according to the preferred embodiment comprises a dipole replacing a monopole of the array antenna apparatus shown in FIG. 1.

Referring to FIG. 5, a feeding antenna element AA0 located in the center of the array antenna apparatus is constituted by comprising a pair of radiating elements 6*a* and 6*b* aligned with each other at a predetermined distance therebetween, and one end of the radiating element 6*a* and one end of the radiating element 6*b*, which face each other, are connected to terminals T11 and T12, respectively. In this case, the terminals T11 and T12 are connected to a radio apparatus through a balanced transmission cable, and the radio apparatus feeds a radio signal to the feeding antenna element AA0.

Each of parasitic variable-reactance elements AA1 to AA6, which are spaced at a predetermined angle on the circumference of a circle around the feeding antenna element AA0, comprises a pair of parasitic elements 7*a* and 7*b* arranged in line with each other at a predetermined distance therebetween. One end of the parasitic element 7*a* and one end of the parasitic element 7*b* facing each other are connected to each other through a varactor diode D1, one end of the varactor diode D1 is connected to a terminal T1 through a resistor R1, and the other end of the varactor diode D1 is connected to a terminal T2 through a resistor R2. A high-frequency bypass capacitor C1 is connected between the terminals T1 and T2. The variable voltage direct-current power supply 30 for applying a backward bias voltage Vb to the varactor diode D1 is connected to the terminals T1 and T2, in a manner similar to that of the first preferred embodiment shown in FIG. 4.

The controller 100 changes the backward bias voltage Vb applied to the varactor diode D1 of each of the parasitic variable-reactance elements AA1 to AA6 through the terminals T1 and T2 by the variable voltage direct-current power supply 30, and thus changes capacitance of each varactor diode D1. Thus, the electric lengths of the parasitic variable-reactance elements AA1 to AA6 each comprising the parasitic elements 7*a* and 7*b* are changed as compared to the electric length of the feeding antenna element AA0, and therefore the a directivity on horizontal plane of the array antenna apparatus can be changed.

As described above, the second preferred embodiment of the present invention shown in FIG. 5 has a very simple structure as compared to the array antenna apparatus of the prior art shown in FIG. 12. For example, the use of the varactor diode D1 makes it possible to realize the array antenna apparatus capable of electronically controlling the directivity at a direct-current voltage. The array antenna apparatus is easily mounted to electronic equipment such as a notebook type personal computer or a PDA so as to serve as an antenna for a mobile communication terminal, for instance. Moreover, even when the main beam thereof is scanned in any direction on a horizontal plane, all the parasitic variable-reactance elements AA1 to AA6 effectively function as wave directors or reflectors and also greatly facilitate the control of the directivity.

MODIFIED PREFERRED EMBODIMENTS

In the above-mentioned preferred embodiments, the description is given with regard to the array antenna apparatus for transmission. However, the apparatus of the present invention can be used for reception in a manner similar to that of the apparatus of the prior art shown in FIG. 12, because the apparatus of the present invention is a reversible circuit including no non-reversible circuit. In the case of the array antenna apparatus for reception, the radiating element 6 is an element for receiving and outputting a radio signal, and the parasitic element 7 is an element that is used for control of the directivity upon receipt of a radio signal but does not output any radio signal. Therefore, in the case of the array antenna apparatus for transmission and reception, the radiating element 6 is an element which a radio signal is inputted to and outputted from, and the parasitic element 7 is an element which no radio signal is inputted to and outputted from.

In the above-described preferred embodiments, the six parasitic variable-reactance elements A1 to A6 or AA1 to AA6 are used, but the directivity of the array antenna apparatus can be electronically controlled as long as the number of parasitic variable-reactance elements is equal to at least one. The directivity of a beam and a direction of a beam can be finely controlled by increasing the number of parasitic variable-reactance elements A1 to A4 or AA1 to AA4, and, for example, the beam width of the main beam thereof can be also controlled so as to narrow the beam width and thus sharpen the main beam.

Moreover, an arrangement of the parasitic variable-reactance elements A1 to A6 or AA1 to AA6 is not limited to the above-described preferred embodiments, and the parasitic variable-reactance elements A1 to A6 or AA1 to AA6 can be arranged at a predetermined distance from the feeding antenna element A0 or AA0. That is, a distance d between the feeding antenna element A0 or AA0 and the parasitic variable-reactance elements A1 to A6 or AA1 to AA6 does not necessarily have to be any constant.

Furthermore, the variable-reactance element 23 is not limited to the varactor diodes D and D1, and it can be any element which can control the reactance. Since each of the varactor diodes D and D1 is generally a capacitive circuit element, its reactance always takes on a negative value. In an example of numeric values shown in Table 1, zero or a positive value is used as impedance Z. The reactance of the above-mentioned variable-reactance element 23 may take on any value within a range from a positive value to a negative value. For A this purpose, for example, the reactance can be changed over a range from a positive value to a negative value by inserting a fixed inductor in series with the varactor diode D or D1, or by further increasing the length of the parasitic element 7.

EXAMPLES

Figure 6:
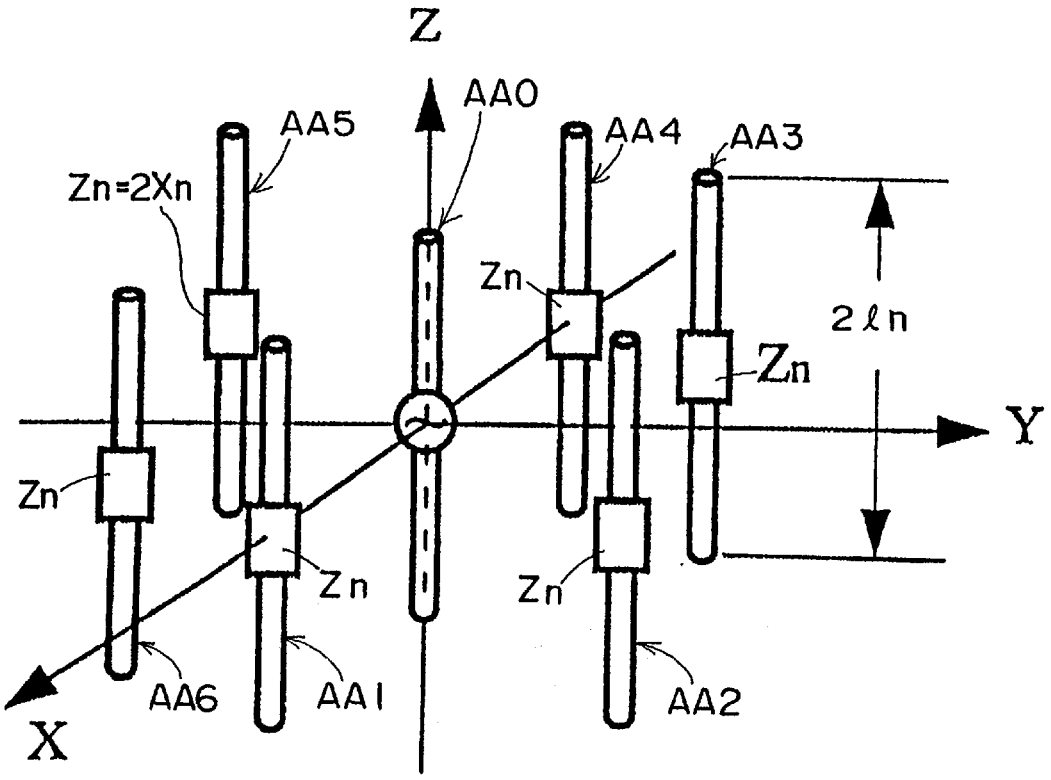
FIG. 6 is a perspective view showing an analytical model of the array antenna apparatus according to the second preferred embodiment.
Figure 7:
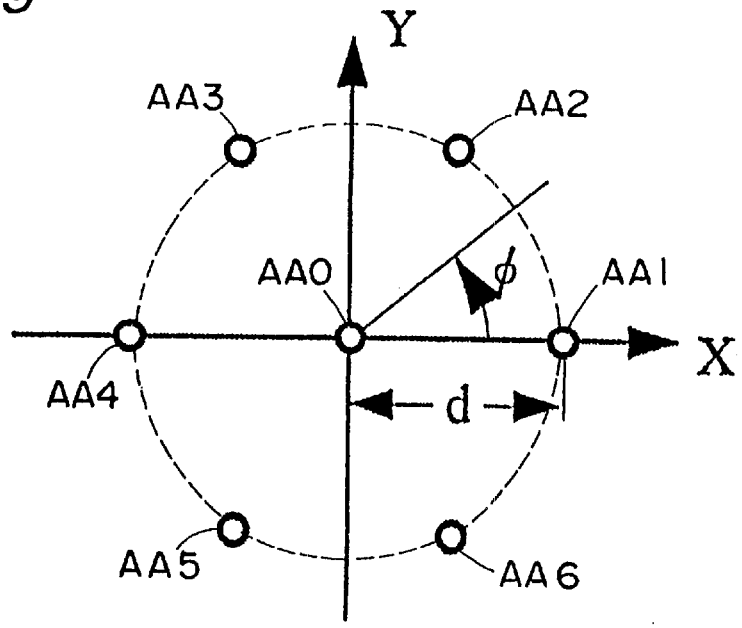
FIG. 7 is a plan view showing a planar arrangement of the array antenna apparatus shown in FIG. 6.
Figure 8:
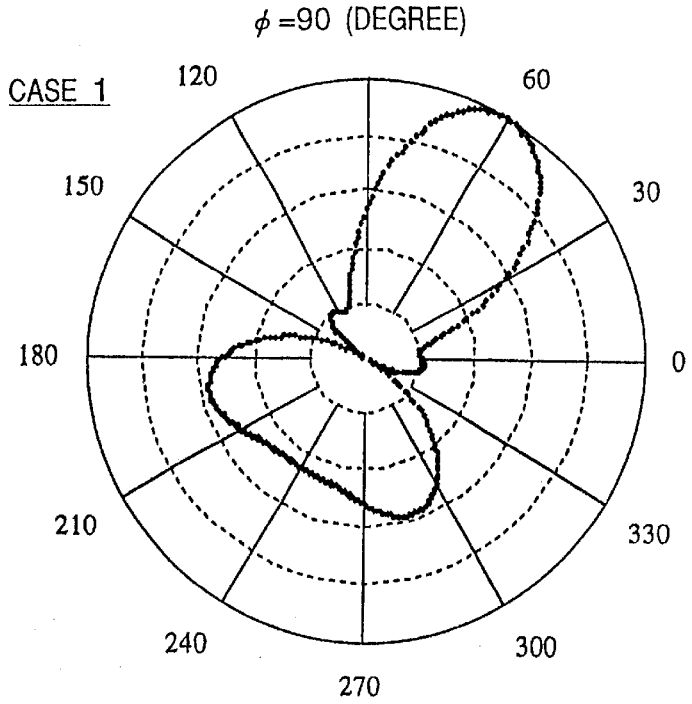
FIG. 8 is a graph showing a directivity on horizontal plane in a case 1 of the array antenna apparatus shown in FIGS. 6 and 7.
Figure 9:
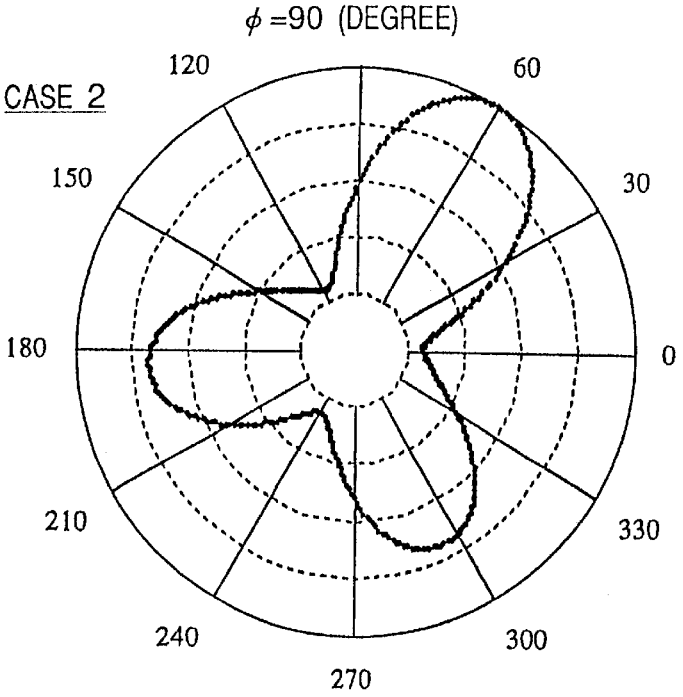
FIG. 9 is a graph showing a directivity on horizontal plane in a case 2 of the array antenna apparatus shown in FIGS. 6 and 7.
Figure 10:
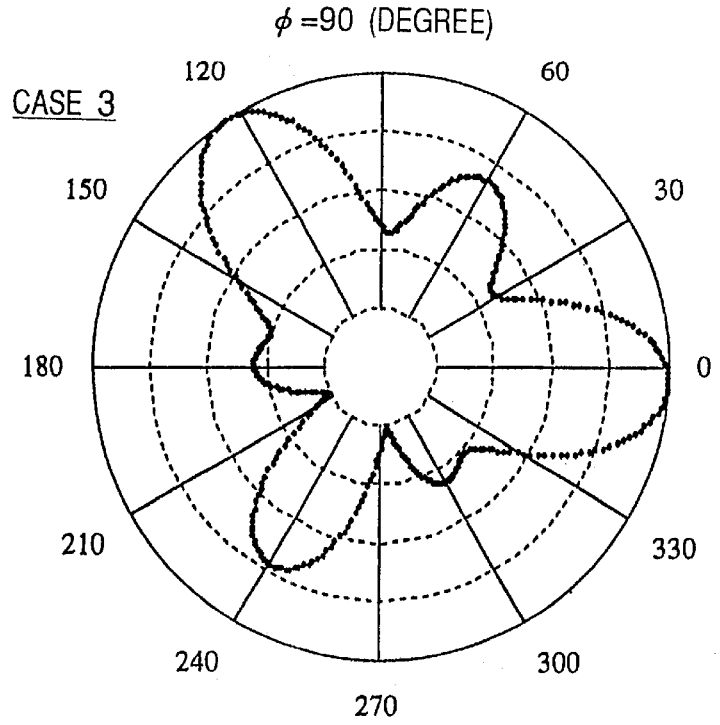
FIG. 10 is a graph showing a directivity on horizontal plane in a case 3 of the array antenna apparatus shown in FIGS. 6 and 7.
Figure 11:
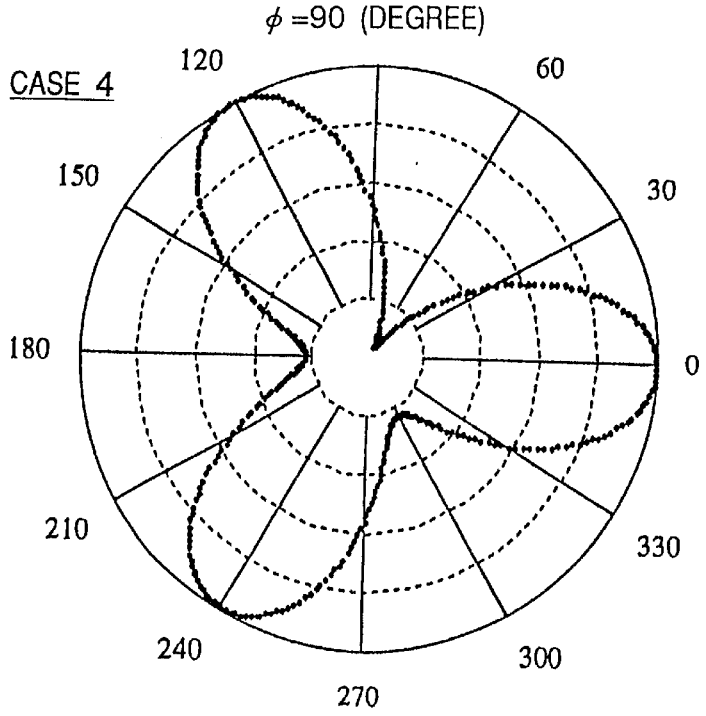
FIG. 11 is a graph showing a directivity on horizontal plane in a case 4 of the array antenna apparatus shown in FIGS. 6 and 7.

The inventor performed the following simulation in order to check performance of the array antenna apparatus according to the above-described preferred embodiments. An analytical model shown in FIGS. 6 and 7 is used in the simulation. Important parameters for design of the array antenna apparatus according to the preferred embodiments are as follows.

(1) The number N and lengths $l_n$ (n=1, 2, . . . , N) of parasitic variable-reactance elements AA1 to AA6: Although N is equal to 6 in the preferred embodiments, this is just an example. Moreover, all the parasitic variable-reactance elements AA1 to AA6 are, preferably, of the same length $l_n$ in consideration of 360-degree scanning.

(2) The distance d between the feeding antenna element AA0 and the parasitic variable-reactance elements AA1 to AA6.

(3) The reactance $X_n$ to be loaded or connected into the parasitic variable-reactance element AAn.

Among these parameters, the above-mentioned parameters (1) and (2) are unchangeable or non-adjustable parameters once they are determined by designing, whereas the above-mentioned parameter (3) is a parameter that can be electronically controlled within some range by the varactor diode D1 as described above. In order to obtain basic data for determining optimum parameters, various kinds of characteristics were calculated by using the method of moments when the parameters of the ESPAR antenna apparatus of the preferred embodiments were changed to some extent. Analysis was performed, assuming that the grounding conductor 11 was infinite and a dipole antenna was arranged in free space. The analytical model is shown in FIGS. 6 and 7. When sets of parameters take on values shown in Table 1, Table 2 shows calculated values of input impedance Zin, gain Gain, angles Deg ($E_{max}$) and Deg ($E_{min}$) when the intensity of the electric field becomes a maximum value ($E_{max}$) and a minimum value ($E_{min}$), respectively, and a ratio $E_{min}/E_{max}$ of the minimum value of the electric field, to the maximum value thereof. In Table 1, $Z_n=X_n$.

TABLE 1

Sets of parameters used for analysis in cases

| Case | N | $1_o$ | $1_n$ | d | $Z_o$ | | | | | |
|---|---|---|---|---|---|---|---|---|---|---|
| | | | | | $Z_1$ | $Z_2$ | $Z_3$ | $Z_4$ | $Z_5$ | $Z_6$ |
| Case 1 | 6 | λ/4 | $0.91_o$ | λ/4 | −j20 Ω | j0 Ω | −j20 Ω | +j20 Ω | j0 Ω | +j20 Ω |
| Case 2 | | | | 1.1λ/4 | | | | | | |
| Case 3 | | | | λ/4 | j5 Ω | −j10 Ω | j5 Ω | −j20 Ω | j20 Ω | −j20 Ω |
| Case 4 | | | | 1.1λ/4 | | | | | | |

TABLE 2

Various kinds of characteristics that were calculated using sets of parameters in respective cases

| Case | Zin (Ω) | Gain (dBi) | Deg ($E_{max}$) (deg) | Deg ($E_{min}$) (deg) | $E_{min}/E_{max}$ (dB) |
|---|---|---|---|---|---|
| Case 1 | 26.55 + j89.75 | 9.84 | 60 | 148 & 332 | −34.71 |
| Case 2 | 29.77 + j91.43 | 8.58 | 60 | 2 & 118 | −12.22 |
| Case 3 | 25.00 + j95.71 | 7.97 | 123 & 357 | 204 & 276 | −13.32 |
| Case 4 | 33.47 + j88.97 | 7.61 | 121 & 359 | 60 | −28.42 |

Results of calculation of patterns of far radiation electric field on a horizontal plane (relative values) are shown in FIGS. 8 to 11. It has been shown that the parasitic variable-reactance elements AA1 to AA6 operate as wave directors or reflectors by appropriately selecting reactance $X_n$ in accordance with the values of the gain Gain shown in Table 2 and the shapes of the patterns of directivity shown in FIGS. 8 to 11. Moreover, as is apparent from comparison among FIG. 8, FIGS. 9 and 10 and FIG. 11, it is understood that the shape of the radiation pattern greatly changes only by slightly changing the value of the distance d.

POSSIBILITY OF INDUSTRIAL UTILIZATION

As described in detail above, an array antenna apparatus according to the present invention comprises a radiating element for transmitting and receiving a radio signal therethrough; at least one parasitic element incapable of transmitting and receiving any radio signal, where the parasitic element is arranged at a predetermined distance from said radiating element; a variable-reactance element connected to said parasitic element; and said array antenna apparatus changes directivity of said array antenna apparatus by changing a reactance of said variable-reactance element. Accordingly, the array antenna apparatus according to the present invention has a very simple structure as compared to that of the array antenna apparatus of the prior art shown in FIG. 12, and, for example, the use of the variable-reactance element such as a varactor diode makes it possible to realize the array antenna apparatus capable of electronically controlling the directivity at a direct-current voltage. The array antenna apparatus is easily mounted to electronic equipment such as a notebook type personal computer or a PDA so as to serve as an antenna for a mobile communication terminal, for example. Moreover, even when the main beam is scanned in any direction on a horizontal plane, all parasitic variable-reactance elements effectively function as wave directors or reflectors and also greatly facilitate the control of the directivity.

What is claimed is:

1. An array antenna apparatus comprising:

a radiating element for transmitting and receiving a radio signal therethrough;

a plurality of parasitic elements each capable of transmitting and receiving any radio signal, said parasitic elements being arranged at a predetermined distance from said radiating element and on a circumference of a predetermined circle around said radiating element;

a plurality of variable-reactance elements connected to said parasitic elements, respectively; and controlling means for changing directivity of said array antenna apparatus by changing a reactance of each of said variable-reactance elements.

2. The array antenna apparatus as claimed in claim 1, wherein each of said variable-reactance elements is a varactor diode, and wherein said controlling means changes a capacitance of each of said varactor diodes by changing a backward bias voltage applied to each of said varactor diodes, thereby changing the directivity of said array antenna apparatus.

* * * * *